US005185996A

United States Patent [19]

Smith et al.

[11] Patent Number: 5,185,996

[45] Date of Patent: Feb. 16, 1993

[54] GAS TURBINE ENGINE SENSOR PROBE

[75] Inventors: Alan A. Smith, Scottsdale; Paul B. Catmull, Gilbert; Lonnie J. Lucas, Chandler; Karl P. Johnson, Tempe, all of Ariz.

[73] Assignee: Allied-Signal Inc., Morris Township, N.J.

[21] Appl. No.: 633,548

[22] Filed: Dec. 21, 1990

[51] Int. Cl.[5] ..... F02G 3/00; F01B 25/26; F01D 25/00; G01K 1/08

[52] U.S. Cl. ..... 60/39.02; 60/39.33; 415/118; 374/144

[58] Field of Search ..... 60/39.02, 39.31, 39.32, 60/39.33; 415/118; 374/144

[56] References Cited

U.S. PATENT DOCUMENTS

| | | | |
|---|---|---|---|
| 2,742,756 | 4/1956 | De Boisblanc | 60/35.6 |
| 2,754,805 | 7/1956 | Beman | 121/38 |
| 2,756,596 | 7/1956 | Nelson et al. | 73/343 |
| 2,971,997 | 2/1961 | Carrico | 136/4 |
| 3,788,143 | 1/1974 | Gabriel | 374/144 |
| 4,011,017 | 3/1977 | Fuerstein et al. | 356/241 |
| 4,132,114 | 1/1979 | Shah et al. | 73/343 R |
| 4,154,434 | 5/1979 | Wallis | 267/119 |
| 4,244,221 | 1/1981 | Scott | 324/158 P |
| 4,244,222 | 1/1981 | Hoyer et al. | 415/118 |
| 4,358,925 | 11/1982 | Williams | 60/39.07 |
| 4,386,498 | 6/1983 | Lee et al. | 415/118 |
| 4,406,580 | 9/1983 | Baran, Jr. | 415/118 |
| 4,426,161 | 1/1984 | Gabriel et al. | 374/144 |
| 4,493,662 | 1/1985 | Taguchi | 440/83 |
| 4,597,675 | 7/1986 | Maertins et al. | 374/115 |
| 4,733,975 | 3/1988 | Komanetsky et al. | 415/118 |
| 4,781,520 | 11/1988 | Balter | 414/751 |

FOREIGN PATENT DOCUMENTS

| | | |
|---|---|---|
| 0599840 | 11/1959 | Italy . |
| 2032536 | 5/1980 | United Kingdom . |
| 2124706 | 2/1984 | United Kingdom . |

OTHER PUBLICATIONS

PCT International Search Report PCT/US91/09579, Apr. 2, 1992.

*Primary Examiner*—Richard A. Bertsch
*Assistant Examiner*—Howard R. Richman
*Attorney, Agent, or Firm*—James W. McFarland; Robert A. Walsh

[57] ABSTRACT

A high temperature thermocouple sensing apparatus is readily removable from a gas turbine engine. The thermocouple extends through aligned openings in inner and outer housings and seals both openings through use of a pair of spherical sealing elements and a spring seal bellows urging a seat into sealing engagement with one sealing element and urging the other sealing element into engagement with the inner housing.

20 Claims, 2 Drawing Sheets

GAS TURBINE ENGINE SENSOR PROBE

TECHNICAL FIELD

This invention relates to sensors as may be utilized in gas turbine engines, and relates more particularly to thermocouples readily insertable and removable from such engines.

BACKGROUND OF THE INVENTION

Control of modern gas turbine engines oftentimes relies upon sensing certain critical operational parameters of the engine, such as a high temperature, high volume gas flow driving the energy extracting turbine blading. It is desirable that sensing apparatus such as thermocouples measuring the temperature at locations within turbine interstages be readily accessible and removable for maintenance and/or replacement purposes. Yet the relatively complex internal geometry of the gas turbine engine, coupled with pressure differentials and extensive variations in thermal response of the various support structure within the engine, conventionally results in emplacement of the thermocouple at a location deeply imbedded within the engine housing structure wherein maintenance and/or replacement requires significant disassembly and reassembly of the overall engine.

SUMMARY OF THE INVENTION

It is an important object of the present invention to provide an access or sensor assembly for gas turbine engines which is readily accessible and removable from the engine without substantial disassembly thereof, yet is so configured and arranged so as to compensate for variations in thermal response in the various engine housing structure.

A more particular object of the present invention is to provide such assembly structure which is readily insertable and removable through both the engine outer housing and an inner engine casing which separates the turbine plenum from the combustion plenum, yet maintains the fluid integrity of both plenums while compensating for relative motion such as variations in thermal growth between the outer housing and the inner casing.

A preferred arrangement of the present invention contemplates an elongated thermocouple probe insertable through aligned openings in the gas turbine engine outer housing and inner casing. The thermocouple carries a pair of spherical protuberances, one of which sealingly engages a seat configured about the opening in the inner casing. The other protuberance sealingly engages an associated seat which is biased into fluid type engagement with the outer protuberance by a hollow, compressible biasing means in the form of a bellows which extends between the second seat and a retainer that partially covers the opening in the outer housing. Preferably the bellows is sealingly welded between the second seat and the retainer to seal the opening in the outer housing. The pair of spherical protuberances allows three dimensional motion to compensate for relative motion between the outer housing and the inner casing. Simply by removal of the outer retainer which is accessible from the exterior of the outer housing, the entire thermocouple probe may be readily removed from the engine.

These and other objects and advantages of the present invention are specifically set forth in or will become apparent from the following detailed description of a preferred embodiment of the invention when read in conjunction with the accompanying drawings.

DETAILED DESCRIPTION OF THE PREFERRED EMBODIMENT

Figure 1:
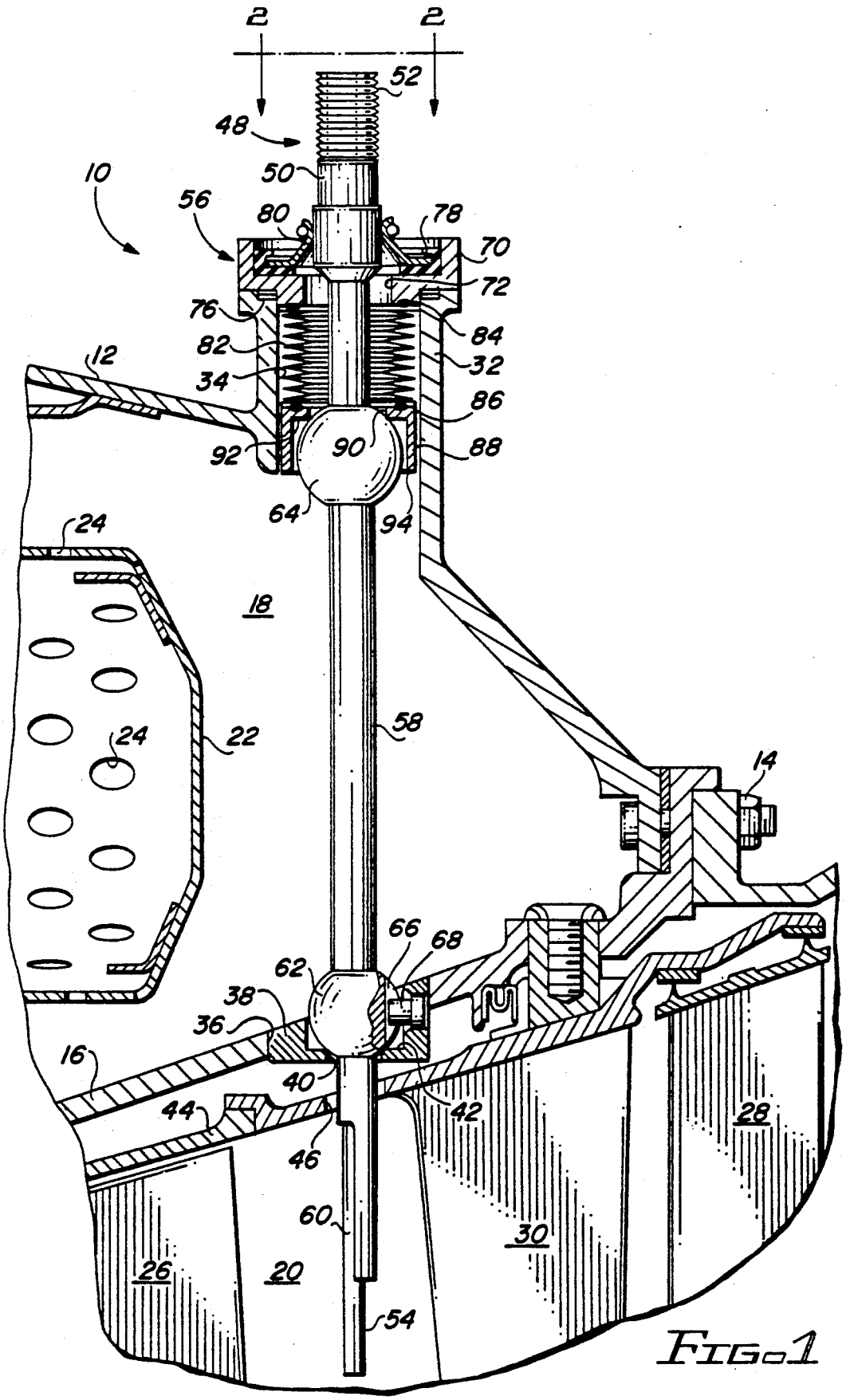
FIG. 1 is a cross-sectional elevational view of a portion of a gas turbine engine incorporating the present invention.
Figures 2, 3:
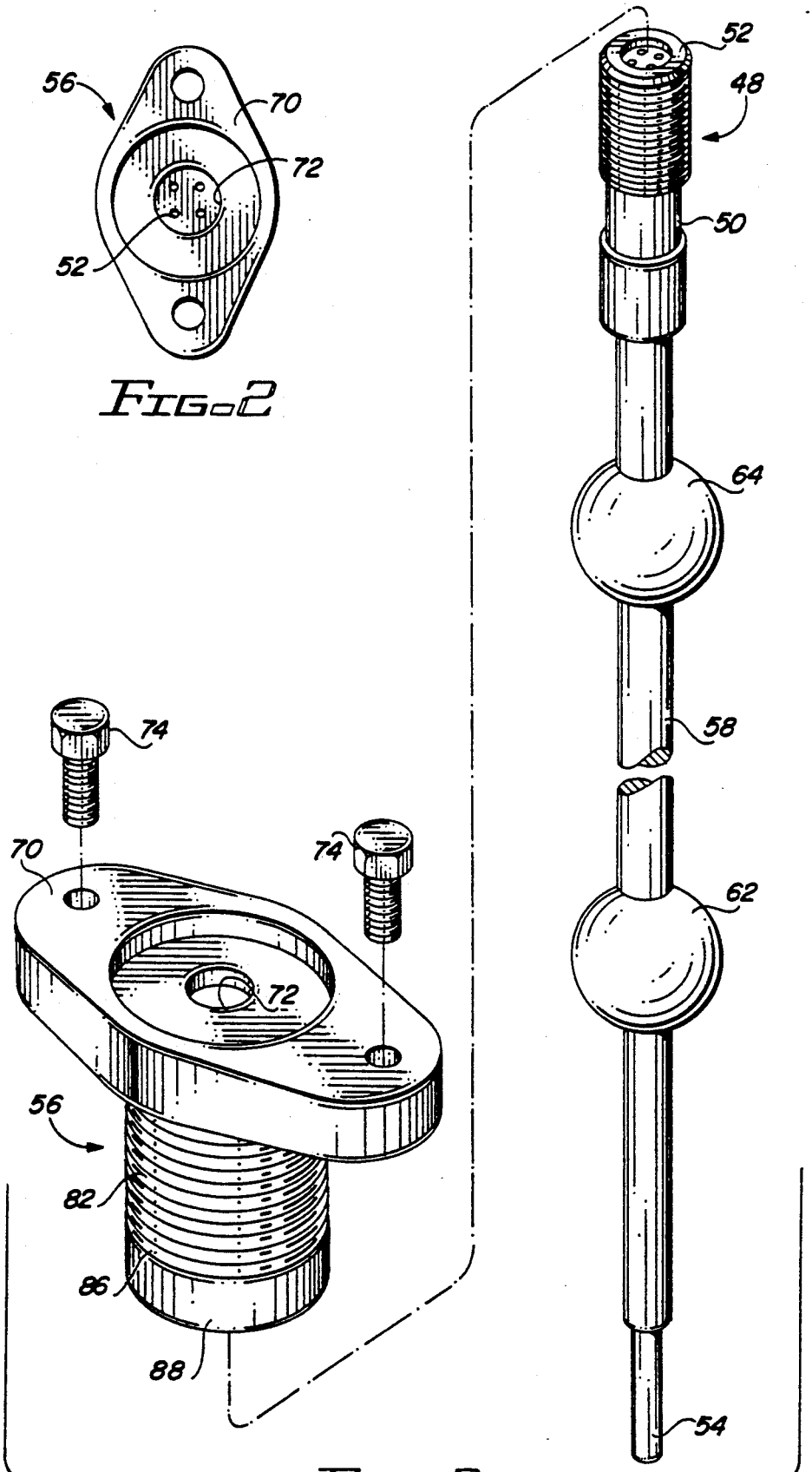
FIG. 2 is a top plan view taken along lines 2—2 of FIG. 1.
FIG. 3 is an exploded perspective view of the thermocouple probe and the outer retainer subassembly of the present invention.

Referring now more particularly to the drawings, a portion of the combustor and turbine sections of a gas turbine engine 10 shown in FIG. 1 includes a cylindrical outer housing or casing 12 secured as by bolts 14 to a cylindrical inner housing or casing 16 to define therebetween a combustor plenum 18. Interiorly within inner casing 16 is defined another fluid plenum in the form of a turbine plenum 20. Combustor plenum 18 is of annular, ring-like configuration extending in circumferentially surrounding relationship to the turbine plenum 20. Disposed within combustor plenum 18 is a combustor liner 22, also of annular configuration, which receives pressurized air flow from plenum 18 through the plurality of orifices 24, as well as a source of combustible fuel (not shown) so that combustion and creation of hot gas flow occurs within the interior of combustor liner 22. Through structure not illustrated, the hot gases generated within the interior of combustor liner 22 are directed radially inwardly to enter the turbine plenum 20. The illustrated arrangement is oftentimes referred to as a reverse flow annular combustor inasmuch as incoming pressurized air enters plenum 20 from a left-to-right direction in FIG. 1, reverses direction, and the combusted gasses exit the plenum in a right-to-left direction.

The hot gas motive flow passes across a plurality of turbine stages within the turbine plenum, turbine blades 26 and 28 of two turbine stages being illustrated in FIG. 1, along with a stage of flow redirecting turbine stator blades 30 shown disposed between the turbine blades 26 and 28. The inner casing 16 must operate to maintain fluid integrity between the combustor plenum 18 and the turbine plenum 20 at all locations other than the gas entry from the combustor to the turbine.

Preferably the outer housing 12 is configured with a radially upstanding boss 32 having a relatively large bore opening 34 extending radially therethrough and in general radial alignment with a similar opening 36 in inner casing 16. Permanently affixed to the opening 36 in the inner casing 16 is an insert seat 38 of hardened material having a central through bore or passage 40 therewithin which effectively defines the opening in inner casing 16 in alignment with the opening 34 in boss 32 of the outer housing. Seat 38 is configured with a axial or transverse face 42 in surrounding relation to passage 40.

The illustrated arrangement of gas turbine engine 10 further includes a stationary internal support structure 44 for supporting the radially depending stator vane 30 and for acting as an annular outer shroud for the tips of the rotating turbine blades 26, 28 in known fashion. This internal structure 44 also includes an opening 46 larger than, and in general alignment with the central through bore 40 in annular seat insert 38.

An illustrated form of an access tube assembly comprises sensing apparatus in the form of a thermocouple sensor probe assembly generally denoted by the numeral 48. The tube or probe assembly generally includes an elongated, thin, rigid tube or sensor probe in the form of a thermocouple 50 having an external outer end 52 disposed exteriorly of outer housing 12, along with an inner, sensor end 54 located inside turbine plenum 20. The sensor probe assembly 48 also generally includes a cover subassembly generally denoted by the numeral 56 which is discussed in greater detail below.

The thermocouple 50 has a rigid outer sheath 58 extending generally between its ends and carrying therewithin insulating such as magnesium oxide 60. The inner end 54 of the sheath is configured as appropriate to provide sufficient exposure of two wire elements, otherwise embedded in material 60, to the turbine plenum 20 for sensing the temperature thereat. The outer end 52 of thermocouple 50 may be conventionally configured as an electrical receptacle for transmitting an electrical output signal indicative of the temperature sensed within turbine plenum 20.

Intermediate the inner and outer ends of thermocouple 50 are provided a pair of spherical sealing elements in the form of spherical protuberances 62, 64 rigidly affixed, as by brazing or welding, to tube 58 and extending radially outwardly therefrom. Inner sealing element 62 is disposed adjacent annular seat 38, while outer sealing element 64 is located adjacent the cover assembly 56. Inner sealing element 62 is sealingly engageable with the transverse face 42 of annular seat 38 to effectively seal the central through bore passage 40 therethrough, while still allowing three-degree motion of the spherical outer surface of inner protuberance 62 relative to the inner casing 16. In this respect, the diameter of central through passage 40 is intermediate that of the diameter of the thermocouple tube 58 and the diameter of the larger protuberance 62. Preferably, inner sealing element 62 includes a slot 66 on one side thereof spaced from the portion of its spherical surface which engages the seat 38, and at one side thereof. An alignment pin 68 is carried within slot 38 and extends loosely into slot 66 so as to hold the thermocouple 50 in a desired orientation within the turbine plenum 20, for instance with the exposed portion 60 facing in an upstream direction therewithin, but without interfering with the permitted rotational movement of element 62 upon seat 38.

The cover assembly 56 generally includes a retainer or cover 70 disposed in partially covering relationship to the opening 34 in boss 32. Retainer 70 further includes a central through bore passage 72 substantially larger in diameter than the portion of the thermocouple 50 extending therethrough. The cover or retainer 70 is readily releasably connectable to outer housing 12 via bolts 74 to trap flexible graphite seals 76 disposed between the inner face of retainer 70 and the top face of boss 32. Preferably, the retainer 70 is also configured to receive a dust cap assembly 78 having an annular elastomeric lip 80 engageable with the thermocouple 50 to prevent entry of dust into the interior of outer housing 12.

The cover assembly 56 further includes mechanical biasing means in the form of a hollow, compressible, spring seal bellows 82 having a convoluted, fluid impervious outer wall configured in accordion-like style to function both as a biasing member when compressed, and as a fluid sealing member. The upper or outer end of bellows 82 is sealingly secured as by weld joint 84 in surrounding relationship to the internal passage 72 within retainer 70.

The opposite end of bellows 82 is similarly sealed via a weld joint 86 to an annular seat 88 of configuration very similar to the annular seat 38. In this regard, annular seat 88 includes a central through bore or passage 90 opening onto a transverse face 92 opposite the transverse face of seat 88 to which bellows 82 is affixed. Seat 88 is located for sealing engagement with the outer protuberant sealing element 64 to seal the interior of the cover assembly 56 from the combustor plenum 18 to maintain the fluid integrity of the outer housing 12. When seat 88 is considered as a unitary part of bellows 82, it will be observed the lower end of bellows 82 is effectively configured to sealingly engage member 64. Preferably, annular seat 88 is configured with a depending, cylindrical outer guide flange 94 loosely received within the bore 34 in boss 32 but sufficiently closely located thereto to provide radial guidance of the cover assembly when inserted through opening 34.

The entire sensor probe assembly 48 is readily assembled within the gas turbine engine 10 by first, if desired, slipping the cover subassembly 56 over the outer end 52 of the thermocouple 50 so that annular seat 88 comes to rest against protuberance 64. The outer portion of thermocouple 50 readily slips through the bore 90 and annular seat 88 to traverse the interior of bellows 82 and central passage 72 in retainer 70. Together the thermocouple 50 and cover assembly 56 easily slip through opening 34 in boss 32 to allow the thermocouple to be directed radially inwardly such that its inner sensor end 54 traverses through central through bore passage 40 and seat 38 and the associated passage 46 in structure 44 until the inner protuberant sealing element 62 comes to rest against seat 38. In this process, the thermocouple is aligned to the desired orientation relative to turbine plenum 20 by rotation until slot 66 aligns with and loosely receives the alignment pin 68 associated with seat 38.

Securement of the sensor probe assembly 48 to the gas turbine engine simply then requires the tightening of bolt or bolts 74 to intersecure the retainer 70 to boss 32 of the outer housing 12. Upon tightening of bolts 74 the bellows 82 begins compressing to urge annular seat 88 into sealing interengagement with the outer spherical surface of sealing element 64. The mechanical biasing force exerted by the bellows 82 is transmitted through the seat 88 and sealing element 64 to, in turn, force the inner sealing element 62 into sealing inner engagement with the annular seat 38 to provide a method for sealing the aligned openings in both engine housings.

As a result, in its assembled position the thermocouple 50 may still allow relative motion between the inner housing 12 and inner casing 16 in three degrees of freedom by virtue of the rotation of the spherical surfaces associated with the sealing element 62, 64 upon the associated seats 38 and 88. Thus, the inner and outer sealing element 62, 64 maintain the fluid integrity of the inner and outer housing 16, 12 while still compensating for the significant excursional movements therebetween caused by pressure differentials and the variations in thermal responsiveness thereof. At the same time, transmittal of bending stresses to the main thermocouple is minimized.

It will be observed that the configuration and location of the sensor probe assembly 48 is such that the net pneumatic force exerted thereon by the pressures in the turbine plenum 20 and combustor plenum 18 urges the sensor probe assembly 48 in a radially outward direction. The bellows 82 is configured and arranged to exert a net downward or inward mechanical biasing force sufficient to overcome this net pneumatic force and urge the seat 88 into sealing engagement with sealing element 64, as well as to urge surface 62 into sealing engagement with seat 38. The main body of the rigid sheath 58 of the thermocouple 50 must be designed sufficiently strongly to minimize bending and avoid buckling while transmitting the biasing force of the compressed bellows therethrough to the lower or inner sealing element 62. It is also important that the biasing force of the bellows be limited to assure that the probe may rotate slightly on the seats 38, 88 as relative motion occurs between the housings.

Disassembly of the sensor probe assembly 48 simply involves removal of bolts 74 to allow straightforward removal of both the thermocouple 50 and the cup assembly 56 from the engine in the reverse manner as described above with respect to assembly. In contrast, typical prior art structures with a thermocouple hard-mounted upon the inner casing, requires significant engine disassembly for thermocouple removal.

The arrangement as described and illustrated has been found quite successful in withstanding the sometimes extensive vibrational environment associated with a gas turbine engine. In fact, the spherical surfaces of sealing element 62, 64 allow sufficient relative motion between their associated knife-edge seats to utilize the natural vibrations within the gas turbine engine to avoid "self welding", galling, fretting or sticking during extended engine operation. Preferably, the outer surfaces of the spherical sealing elements 62, 64, are very smooth, with a surface roughness of eight micro inches or less, and the seats 38, 88 are comprised of a very hard material such as Haynes Stellite 31 in relation to utilization of materials such as Haynes 25 in the spherical element 62, 64. A certain amount of oxidation of the seats 38, 88 then provides small lubrication on the wear surfaces of the associated spherical elements 62, 64. As wearing occurs the preload offered by bellows 82 continues to provide a seating force maintaining the necessary sealing. Such indication of useful materials for the sealing elements 62, 64 and the associated seats 38, 88 are merely representative of those which may be utilized in the present invention.

The foregoing detailed description of the preferred embodiment of the present invention should be considered exemplary in nature and not as limiting to the scope and spirit of the present invention as set forth in the appended claims.

Having described the invention with sufficient clarity that those skilled in the art may make and use it, what is claimed is:

1. A method for sealing aligned openings in inner and outer housings of a gas turbine engine having a readily removable thermocouple extending through both of the aligned openings, comprising the steps of:

securing a cover to the outer housing in covering relation to the opening therein;

compressing a spring bellows in response to said securing step to create a biasing force urging a seat into sealing engagement with a first spherical sealing element carried on the thermocouple; and transmitting the biasing force through the thermocouple to urge a second spherical sealing element carried on the thermocouple into engagement with the inner housing to seal the opening therein.

2. In a gas turbine engine having concentric inner and outer housings with generally radially aligned openings therein, said housings defining a combustor plenum therebetween and a fluid plenum inside said inner housing, a readily accessible sensor probe assembly comprising:

a retainer removably secured to said outer housing in covering relation to said opening therein, said retainer having a passage therethrough;

a rigid, elongated sensor probe extending through said passage and said opening in the inner casing with an outer end disposed exteriorly of said outer housing and an inner sensor end disposed in said fluid plenum;

inner and outer sealing elements secured to said probe and having at least partially spherical outer surfaces, said spherical surface of the inner sealing element being engageable with said inner housing to seal said opening therein;

an annular seat located for sealing engagement with said spherical surface of the outer sealing element; and compressible mechanical biasing means extending between said retainer and said seat for urging the latter into sealing engagement with said outer sealing element for urging said inner sealing element into sealing engagement with said inner housing;

means for sealing said passage in the retainer from said combustor plenum; and an alignment pin extending from said inner housing into slidable engagement with said inner sealing element for holding said sensor end of the probe in preselected orientation in said fluid plenum.

3. A gas turbine engine comprising:

generally concentric inner and outer casings defining an annular hot gas combustor plenum therebetween, said inner and outer casings having generally radially aligned openings therein;

a hot gas turbine section disposed within said inner casing;

a cover removably secured to said outer casing in partially covering relation to said opening therewithin, said cover having a passage therethrough;

a hollow compressible, fluid impervious, spring bellows having one end sealingly secured to said cover and extending radially inwardly toward said combustor plenum;

a first annular seat sealingly secured to an opposite end of said spring bellows, said seat having a passage therethrough;

a second annular seat sealingly secured to said inner casing in partially covering relation to said opening therein, said second seat having a passage therethrough;

an elongated thermocouple probe extending radially inwardly and loosely through the hollow bellows and said passages in the cover and the first and second seats, with an external end disposed exteriorly of said outer casing and an internal end disposed in said turbine section;

a pair of spherical protuberances carrier on said probe, said spring bellows operable to urge said first seat radially inwardly into sealing engagement with one of said protuberances, and to urge the other of said protuberances radially inwardly into sealing engagement with said second seat, said protuberances being rotatable upon their associated seats while retaining sealing engagement therewith to accommodate relative motion between said inner and outer casings, said other of the protuberances having a slot therein spaced from said passage in the second seat; and an alignment pin extending from said second seat into said slot for holding said internal end of the probe in preselected orientation in said turbine section.

4. An access tube assembly adapted to be readily inserted and removed through aligned openings in spaced outer and inner housings in a gas turbine engine, comprising:

an elongated, rigid tube having inner and outer ends, said inner end adapted to be inserted through both said aligned openings, said tube being of a length greater than the distance between said aligned openings;

inner and outer spherical sealing members secured to said tube in spaced relationship at locations intermediate said inner and outer ends thereof, said inner sealing member adapted to sealingly engage the inner housing to seal said opening therein;

a cover disposed between said outer sealing member and said outer end of said tube, said cover having a passage through which said tube extends, said cover adapted to be secured to the outer housing in partially covering relation to said opening therein; and hollow compressible bellows through which said tube extends, said bellows having one end sealingly secured to said cover and having an opposite end configured to sealingly engage said outer sealing member, said bellows adapted to be compressed between said cover and said outer sealing member to urge said inner sealing member into sealing engagement with the inner housing upon securement of said cover to the outer housing.

5. A sensor assembly adapted to be readily inserted and removed through aligned openings in inner and outer housings in a gas turbine engine, and affording sealing of both openings when inserted, comprising:

an elongated sensor probe adapted to loosely fit through said openings, said probe having inner and outer protuberances thereon, said inner protuberance adapted to sealingly engage the inner housing to seal the opening therein;

a cover having a passage through which said probe extends, said cover adapted to be removably secured to the outer housing in covering relationship with the opening therein;

a hollow compressible bellows having one end sealingly attached to said cover and an opposite end adjacent said outer protuberance; and a seat having a passage through which said probe extends, said seat sealingly attached to said opposite end of said bellows and biased by said bellows into sealing engagement with said outer protuberance.

6. In a gas turbine engine having concentric inner and outer housings with generally radially aligned openings therein, said housings defining a combustor plenum therebetween and a fluid plenum inside said inner housing, a readily accessible sensor probe assembly comprising:

a retainer removably secured to said outer housing in covering relation to said opening therein, said retainer having a passage therethrough; .

a rigid, elongated sensor probe extending through said passage and said opening in the inner casing with an outer end disposed exteriorly of said outer housing and an inner sensor end disposed in said fluid plenum;

inner and outer sealing elements secured to said probe and having at least partially spherical outer surfaces, said spherical surface of the inner sealing element being engageable with said inner housing to seal said opening therein;

an annular seat located for sealing engagement with said spherical surface of the outer sealing element; and compressible mechanical biasing means extending between said retainer and said seat for urging the latter into sealing engagement with said outer sealing element and for urging said inner sealing element into sealing engagement with said inner housing.

7. The invention of claim 6, further including means for sealing said passage in the retainer from said combustor plenum.

8. The invention of claim 7 wherein said biasing means comprises a hollow compressible bellows.

9. The invention of claim 8, wherein said means for sealing includes a weld joint between said retainer and one end of said bellows, said bellows being fluid impervious.

10. The invention of claim 9, wherein said annular seat has a central through bore through which said probe extends, and opposed faces extending transversely to the major dimension of said probe, one of said opposed faces urged into sealing engagement with said spherical surface of the outer sealing element and the other of said opposed faces being sealingly secured to a second end of said bellows.

11. The invention of claim 6, wherein said probe is a thermocouple for measuring temperature within said fluid plenum.

12. In a gas turbine engine having an outer housing and an internal casing defining a combustor plenum therebetween, said outer housing and internal casing having generally aligned openings;

a retainer removably secured to the outer housing in partially covering relation to said opening therein, said retainer having a passage therethrough;

an elongated thermocouple probe extending through said passage in the retainer and said opening in the internal casing, said probe traversing said combustor plenum and having an outer end disposed exteriorly of said outer housing and an inner end disposed interiorly of said internal casing;

a hollow, compressible spring seal bellows having one end sealingly secured to said retainer in surrounding, sealing relationship to said passage in the retainer and extending inwardly from said retainer;

a seat sealingly secured to an opposite end of said bellows and having a passage through which said probe extends; and at least partially spherical, inner and outer sealing elements carried on said probe and disposed respectively adjacent said internal casing and said seat, and bellows being compressible between said retainer and said seat to bias the latter into engagement with said outer sealing element to seal said passage in the seat, and to urge said probe inwardly to bias said inner sealing element into engagement with said internal casing to seal said opening therein.

13. A gas turbine engine comprising:

generally concentric inner and outer casings defining an annular hot gas combustor plenum therebetween, said inner and outer casings having generally radially aligned openings therein;

a hot gas turbine section disposed within said inner casing;

a cover removably secured to said outer casing in partially covering relation to said opening therewithin, said cover having a passage therethrough;

a hollow compressible, fluid impervious, spring bellows having one end sealingly secured to said cover and extending radially inwardly toward said combustor plenum;

a first annular seat sealingly secured to an opposite end of said spring bellows, said seat having a passage therethrough;

a second annular seat sealingly secured to said inner casing in partially covering relation to said opening therein, said second seat having a passage therethrough;

an elongated thermocouple probe extending radially inwardly and loosely through the hollow bellows and said passages in the cover and the first and second seats, with an external end disposed exteriorly of said outer casing and an internal end disposed in said turbine section; and a pair of spherical protuberances carried on said probe, said spring bellows operable to urge said first seat radially inwardly into sealing engagement with one of said protuberances, and to urge the other of said protuberances radially inwardly into sealing engagement with said second seat, said protuberances being rotatable upon their associated seats while retaining sealing engagement therewith to accommodate relative motion between said inner and outer casings.

14. A gas turbine engine as set forth in claim 13, wherein said passages are central bores in said cover and first and second annular seats of a diameter intermediate the diameter of said probe and said protuberances.

15. A gas turbine engine as set forth in claim 13 wherein said one end of the bellows is sealingly welded to said cover and said opposite end of the bellows is sealingly welded to said first annular seat.

16. A gas turbine engine as set forth in claim 11, wherein said outer casing has an upstanding boss, said opening in the outer casing comprising a relatively large bore through said boss, said first annular seat having a cylindrical outer guide flange slidably received in said bore of the boss.

17. A sensing apparatus readily insertable and removable through aligned openings in outer and inner gas turbine engine housings, comprising:

an axially elongated sensor probe extending through said aligned openings with a sensor at an inner end disposed inside said inner housing, and an outer end disposed exteriorly of said outer housing;

a retainer removably secured to said outer housing and in covering relation to said opening in the outer housing, said cover having a passage through which said probe extends;

inner and outer sealing members secured to said probe and having at least partially spherical external surfaces, said spherical surface of the inner sealing member being engageable with said inner housing for sealing said opening therein;

an annular seat disposed adjacent to and surrounding said outer sealing member and being sealingly engageable with said spherical surface thereof; and biasing means extending between said retainer and said seat for urging the latter axially inwardly into sealing engagement with said outer sealing member and for urging said inner sealing member axially inwardly into sealing engagement with said inner housing.

18. Sensing apparatus as set forth in claim 17, further including means for sealing said passage in the retainer.

19. Sensing apparatus as set forth in claim 18, wherein said biasing means comprises a hollow compressible bellows.

20. Sensing apparatus as set forth in claim 19, wherein said means for sealing includes a weld joint between said retainer and one end of said bellows, said bellows being fluid impervious.

* * * * *